US006394936B1

(12) United States Patent
Voris

(10) Patent No.: US 6,394,936 B1
(45) Date of Patent: May 28, 2002

(54) CONVERGENT EXERCISE MACHINE AND METHOD

(75) Inventor: Harvey C. Voris, Huntington Beach, CA (US)

(73) Assignee: Paramount Fitness Corp., Los Angeles, CA (US)

( * ) Notice: Subject to any disclaimer, the term of this patent is extended or adjusted under 35 U.S.C. 154(b) by 0 days.

(21) Appl. No.: 09/467,564

(22) Filed: Dec. 20, 1999

Related U.S. Application Data

(63) Continuation of application No. 08/859,942, filed on May 22, 1997, now abandoned

(60) Provisional application No. 60/015,866, filed on May 22, 1996.

(51) Int. Cl.[7] ..... A63B 21/062

(52) U.S. Cl. ..... 482/100; 482/136; 482/139

(58) Field of Search ..... 482/46, 62, 100, 482/142, 136–139; D21/673, 676, 694

(56) References Cited

U.S. PATENT DOCUMENTS

| | | | | | |
|---|---|---|---|---|---|
| 5,145,479 | A | * | 9/1992 | Olschansky et al. | 482/62 |
| 5,344,374 | A | * | 9/1994 | Telle | 482/97 |
| 5,399,133 | A | * | 3/1995 | Haber et al. | 482/49 |
| 5,413,546 | A | * | 5/1995 | Basile | 482/99 |
| 5,707,323 | A | * | 1/1998 | Simonson | 482/97 |
| 5,769,757 | A | * | 6/1998 | Fulks | 482/45 |
| D439,941 | S | * | 4/2001 | Batca et al. | D21/676 |
| D439,943 | S | * | 4/2001 | Webber et al. | D21/694 |
| D440,609 | S | * | 4/2001 | Batca et al. | D21/675 |
| D440,610 | S | * | 4/2001 | Webber et al. | D21/675 |

FOREIGN PATENT DOCUMENTS

| | | | | |
|---|---|---|---|---|
| AU | 653426 | * | 3/1993 | 482/92 |
| CA | 658291 | * | 2/1963 | 482/100 |
| FR | 1226506 | * | 7/1960 | 482/100 |
| WO | WO-87/01601 | * | 3/1987 | 482/133 |

* cited by examiner

*Primary Examiner*—Jeanette Chapman
*Assistant Examiner*—Victor Hwang
(74) *Attorney, Agent, or Firm*—Fulbright & Jaworski L.L.P

(57) ABSTRACT

Convergent exercise machines and a method using resistance for exercising the upper torso and arm muscles, for complete natural joint articulation of shoulders, elbows and wrists. The circular exercise motion path is machine-determined and defined by a pair of exercise arms, each arm rotating about an arm pivot axle and having a handle assembly with a wrist joint accommodating pivot. The diameter of the circular exercise motion path is adjusted for the user's arm length. The method includes the following steps: defining the position of the arm pivot axle so that the machine-determined circular exercise motion path is coincident with the movement of the wrist joint accommodating pivot from start to finish of an exercise, and defining the position of the arm pivot axle to be located in a plane parallel to the plane positioned through the user's shoulder joints and at a lateral displacement from it, and at a location further into the exercise stroke than the parallel plane. The method has a further step of adjusting the position of the exercise arm handles to accommodate user's arm length. Wrist joint accommodating pivots allow the user's hand to move in a non-circular motion path. Each type of the machine of the present invention can be made with a singular arm pivot axle, two co-linear arm pivot axles or two co-planar parallel arm pivot axles.

7 Claims, 12 Drawing Sheets

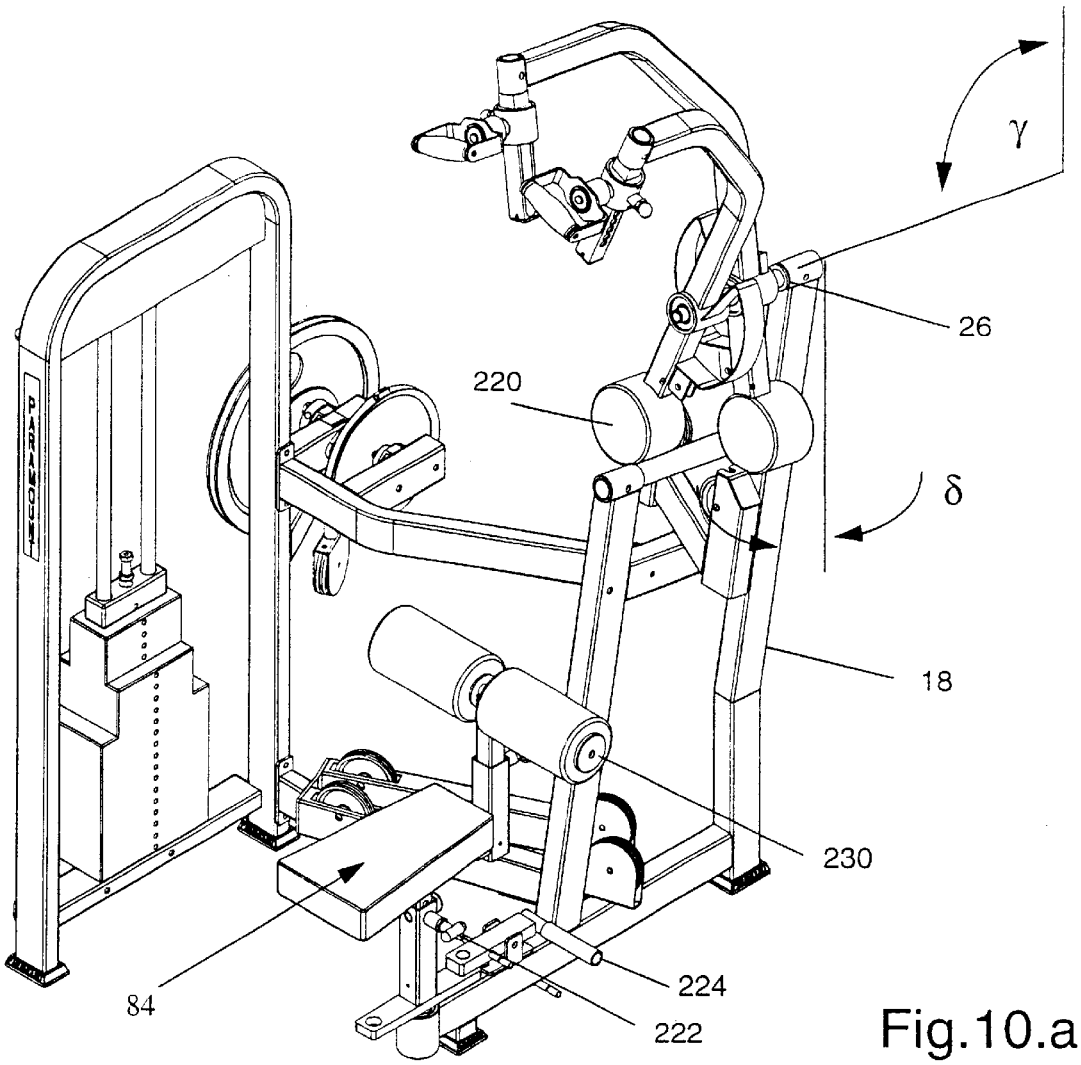
Fig.10.a
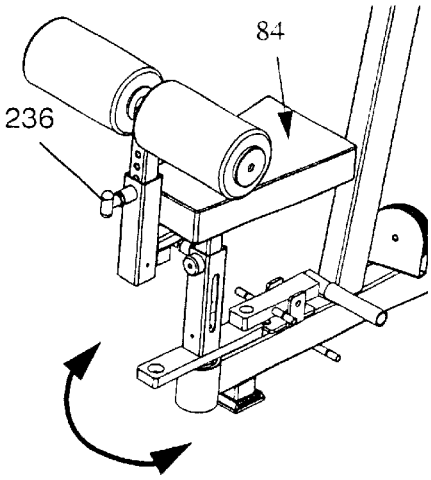
Fig.10.b

CONVERGENT EXERCISE MACHINE AND METHOD

This application claims the benefit of the Provisional Patent Application Ser. No. 60/015,866 filed on May 22, 1996.

This application is a continuation of U.S. application Ser. No. 08/859,942, filed May 22, 1997, now abandoned, which claims the benefit of U.S. Provisional Application No. 60/015,866, filed May 22, 1996, both of which are incorporated herein by reference.

BACKGROUND OF THE INVENTION

1. Field of the Invention

The present invention relates generally to the field of convergent exercise machines using resistance for exercising the upper torso and arm muscles for a complete natural joint articulation of shoulders, elbows and wrists, and more particularly to a method and exercise machines having a pair of exercise arms, attached on at least one pivot, which are moving in a machine-determined circular exercise motion path, where the position of the handles attached to the arms can be adjusted for varying the diameter of the machine-determined circle, and where each handle allows the user's hand to move in a non-circular motion path, to facilitate complete natural articulation of the user's arms.

2. Brief Description of the Prior Art

Free weights are popular among many weight lifters because the lifting movements are not restricted to prescribed planes of motion and at prescribed angles. Conventional exercise machines provide a workout for the upper torso and arms with limited benefits. Conventional convergent plane free-weight machines were introduced by Hammer Strength Corporation in late 80's and covered by U.S. Pat. Nos. 5,050,873, 5,181,896, 5,135,456 and 5,044,631, issued to Jones. Hammer machines typically operate with a set of levers, pivotally connected to the frame behind and above the seat, and they pivot from a wide to a narrow position.

In Hammer machines, a pair of independently pivoting arms is suspended on a pair of axes, defining arcuate exercise motion paths centered at the respective pivot axis of each pivoting arm. The arms pivot in two convergent planes, which allows for standard exercise movements to be performed to achieve articulation of the shoulder and elbow, but the distance between the handles and the user's body cannot be varied to accommodate for longer or shorter arms. Although Hammer machines constrain the user to the machine-determined exercise motion paths, they have the same starting position for all users, thus benefiting the tall users, and do not provide an optimum exercise motion path, comfortable and adequate for smaller users.

Other types of conventional machines allow the user to define his own arcuate exercise motion path. An example of these machines is disclosed in U.S. Pat. No. 4,949,951, issued in 1990 to Della. Deola's machine has a suspended U-shaped pivoting member, resembling a conventional press arm, with two bar members with handles, connected to the lower ends of the U-shaped member by universal joints. However, the resistance of this machine is only associated with the pivoting U-shaped member, and the user does not get full benefit of the movements at the universal joints of the handles. Further, since the user has a complete freedom of movement of the handles, and the handles and arms are moving in opposing planes, the motion is very uneven and jerky. Thus, there is a long learning curve to develop the correct feel for the machine.

Body Masters Sport Industry, Inc. has a machine model CH 504, which includes a pair of exercise arms, each of which pivots about its own respective vertical axis located approximately in line with the user's shoulder joint. Handgrips are suspended from the overhead exercise arms and rotate forwardly and inwardly through symmetric circular arcs, concave with respect to the user's torso. The machine can vary handle movement to adjust for varying arm lengths, and allows for complete articulation of the shoulders, but provides no benefits to biceps and triceps, since the elbows are fixed.

U.S. Pat. No. 5,437,589, issued in 1995 to Habing, describes an upper body exercise machine with a machine-determined exercise motion path, which is also optimally suited for tall people, because the user is confined to start at a pre-determined position and the ending point depends on the length of the user's arms. The machine has a pair of symmetrically articulated exercise arm assemblies, each of which is pivotally attached to the frame with a complicated four-bar linkage. In one embodiment of the Habing device, the geometry of the arms and their two pivot points are arranged so that the handgrips of the arms follow non-circular arcuate exercise motion paths. The exercise motion paths arc outwardly and converge as the handgrips are moved forwardly, in a plane slightly inclined from a horizontal plane, so the user need not support the weight of the exercise arms.

In one embodiment of Habing device, the exercise motion paths are symmetrical circular concave arcs, concave to the user's torso, lying in a plane slightly inclined from horizontal, and perpendicular to the axes of the pivots. However, the handgrips are fixed and not adjustable. Another disadvantage of the Habing machine is that the series of pulleys and cables are designed in such a way that the resistance depends upon the angles at which the cables attach to the arms, and thus the machine does not follow the variable force curve for the muscle being exercised.

SUMMARY OF THE INVENTION

The preceding and other shortcomings of prior art systems are addressed and overcome by various aspects of the present invention, which consist of convergent exercise machines for exercising the upper torso and arms, to provide all of the conventional exercises, commonly practiced and presently only available using the free-weights, with improved exercise results.

One embodiment of the present invention is a method for natural joint articulation of shoulders, elbows and wrists, using a convergent exercise machine for exercising the upper torso and arm muscles. The circular exercise motion path is machine-determined and defined by a pair of exercise arms, each arm rotating about an arm pivot axle and having a handle assembly. The diameter of the circular exercise motion path is adjusted for the user's arm length. The method includes the following steps: defining the position of the arm pivot axle so that the movement of a handle assembly pivot is coincident with the machine-determined circular exercise motion path, and defining the position of the arm pivot axle at a location in a plane parallel to the plane positioned through the user's shoulder joints and at a lateral displacement from it, at a location further into the exercise stroke than the plane positioned through the user's shoulder joints. The method has a further step of adjusting the position of the exercise arm handles to accommodate user's arm length. The handle assembly pivot is preferably a wrist joint accommodating pivot.

Another embodiment of the present invention is a convergent exercise machine using resistance for exercising the user's upper torso and arm muscles, for complete natural joint articulation of shoulders, elbows and wrists. The machine has a support frame having a support frame member and at least one arm pivot axle connected to the support frame member, and a pair of exercise arms rotatably attached to the arm pivot axle. The exercise arms move in a machine-determined circular exercise motion path having a predetermined diameter, and each exercise arm has a first end rotatably connected to the arm pivot axle and a second end having a handle assembly mounted to the exercise arm and adapted to be grasped by the user's hand and pulled toward or away from the user.

The handle assembly pivot is preferably a wrist joint accommodating pivot. The position of the arm pivot axle is located in a plane parallel to the plane positioned through the user's shoulder joints and at a lateral displacement from it, and at a location further into the exercise stroke than the plane positioned through the user's shoulder joints. The position of the arm pivot axle is located so that the machine-determined circular exercise motion path is coincident with the movement of the wrist joint accommodating pivot from start to finish of an exercise, to accommodate the natural musculoskeletal makeup of a person performing an exercise.

A variable resistance system, which has at least one weight and a load multiplying eccentric cam system, is used to provide a varying weight resistance during the displacement of the exercise arms, in order to train all muscle groups in the users upper torso and arms through the natural strength curve.

In two embodiments of the present invention, representing machines used with pressing movement, the handle assembly has a handgrip stirrup which is offset forward of the wrist joint accommodating pivot. The wrist joint accommodating pivot is located in line with the user's wrist joint for rotation of the user's wrist joint about the wrist joint accommodating pivot. In two other embodiments of the present invention, representing machines used with pulling movement, the wrist joint accommodating pivot is located in line with the user's hand and in line with the handgrip stirrup.

In addition, each type of the machine of the present invention can be made with a singular arm pivot axle, two co-linear arm pivot axles or two co-planar parallel arm pivot axles. By using the techniques of the present invention, much more compact machine configurations are obtainable, thus considerably decreasing the floor area occupied by these machines.

The foregoing and additional features and advantages of this invention will become further apparent from the detailed description and accompanying drawing figures that follow. In the figures and written description, numerals indicate the various features of the invention, like numerals referring to like features.

BRIEF DESCRIPTION OF THE DRAWINGS

FIGS. 10*a* and 10*b* are perspective views of a lat pull-down machine, according to another embodiment of the present invention.

DETAILED DESCRIPTION OF THE INVENTION

This invention relates to a system of convergent machines for exercising the user's upper torso and arms, having a pair of exercise arms attached on at least one pivot axle. The exercise arms are moving in a machine-determined circular exercise motion path. The position of the handles of the arms can be adjusted for varying the diameter of the machine-determined circular exercise motion path. Each exercise arm has a handle assembly with a pivot, preferably a wrist joint accommodating pivot. The wrist joint accommodating pivots and the arm pivot axle(s) allow the user's hand to move in a non-circular motion path. The machine arm pivot axle(s) are uniquely positioned so that the exercise motion path is optimal for individuals of all sizes and experience levels. Each type of the machine of the present invention can be made with a singular arm pivot axle, two co-linear arm pivot axles or two co-planar parallel arm pivot axles.

Figure 1:
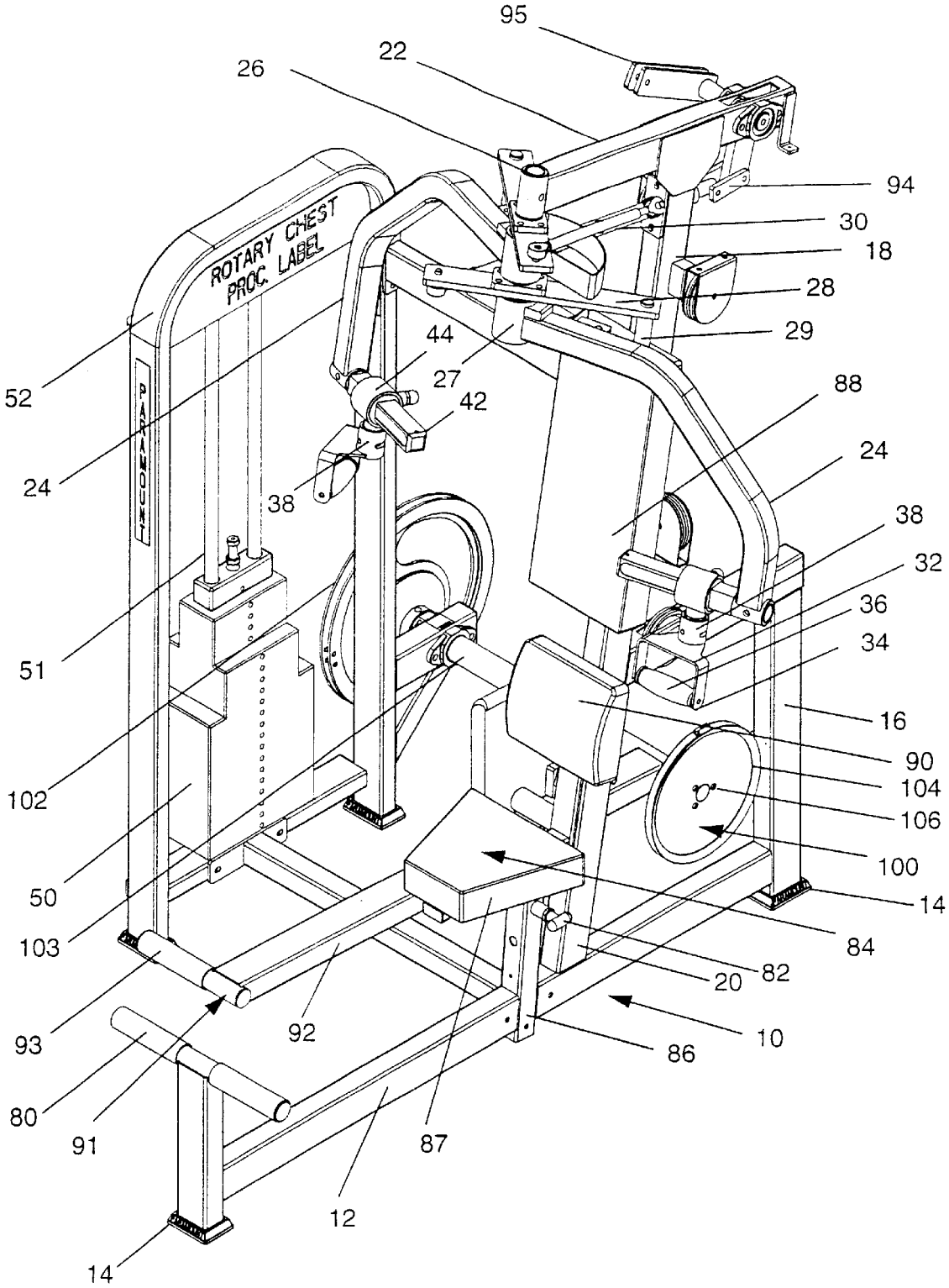
FIG. 1 is a perspective view of a chest press machine of the first embodiment of the present invention, having a singular axle.

FIG. 1 is a perspective view of a chest press machine, showing basic architecture of one embodiment of the present invention for training chest muscles. The same basic principle can be applied to the other three types of machines, for training shoulder muscles, for training upper back muscles and for lat pulls, shown in FIGS. 6–10, which can have one or two axles. Therefore, in order to simplify the description, only the machine embodiment with a singular axle will be described in detail.

All these machine models of the present invention allow for complete shoulder, elbow and wrist joint articulation through a natural ergonomic exercise motion path. User's shoulder, elbow and wrist joints are taken through their complete ranges of motion during the course of the exercise movement, without wrist impingement, thus decreasing the stress in the joints and keeping the proper muscle balance.

As shown in FIG. 1, the chest press machine of the present invention has a sturdy and rigid frame 10. The frame 10 is a combination of individual straight and curved frame members and is preferably structural steel tube frame. Some of the individual frame members have rectangular cross-section, preferably sized 1.5"×3" or 2"×3", and some have square cross-section, preferably sized 2"×2". The frame 10 is preferably covered with an electrostatically applied powder coat finish, for enhanced appearance and durability. The individual frame members are joined together by welding, mechanical fasteners or other appropriate means. One individual frame member is a frame base member 12 which is supported above the ground on a set of custom molded feet 14, to insure stability of the machine and prevent marring of the floor surface. An upright frame member 16 extends upwardly from the back end or, in some machines, from the forward end of the frame base member 12. A support frame member 18 extends from an intersection 20 with the frame base member 12, is partially supported by the upright frame member 16 and is positioned in a plane backwardly declined from a vertical plane at an angle, preferably of 10 degrees.

Figure 3:
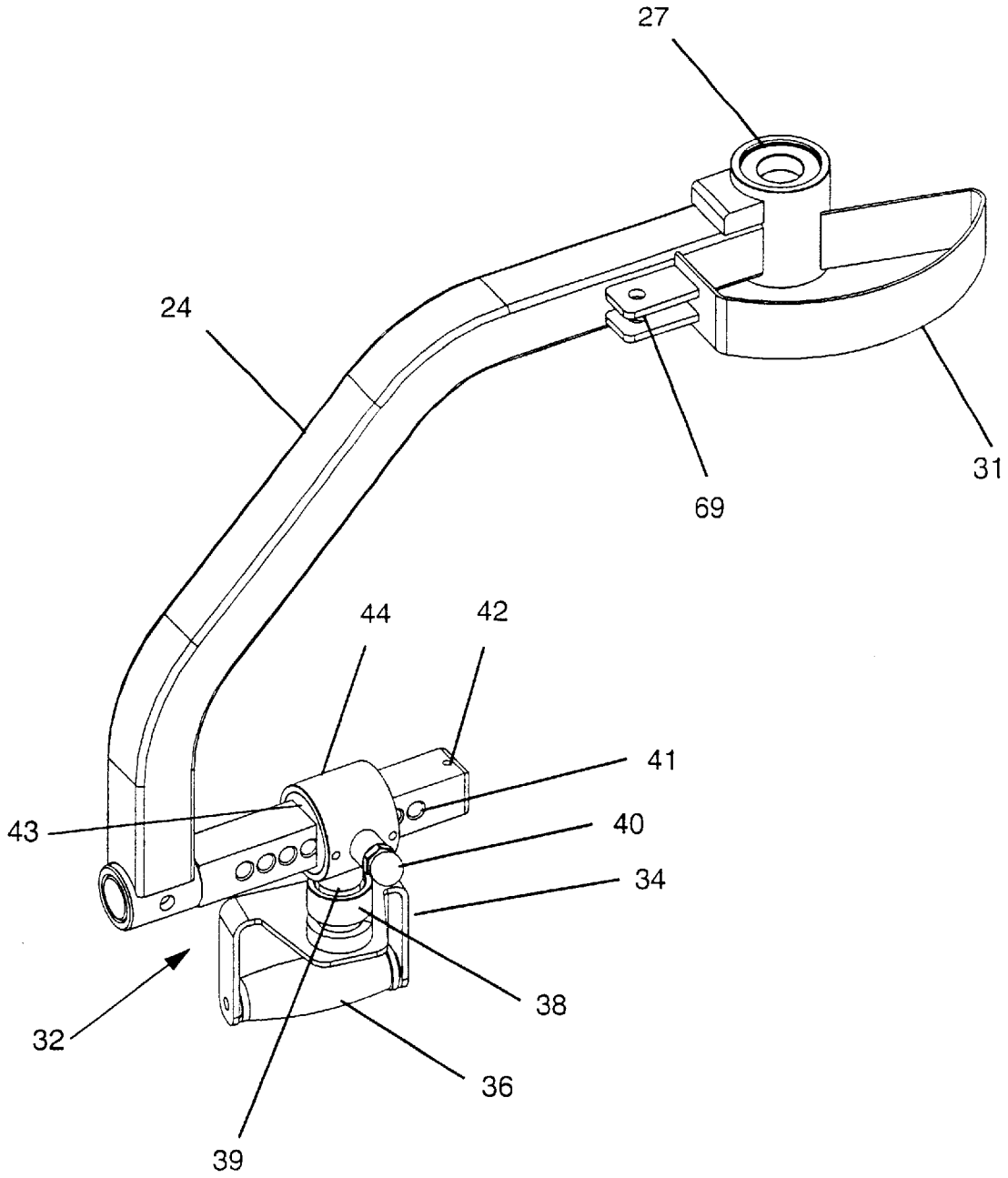
FIG. 3 is a perspective view of an exercise arm of all embodiments of the present invention.
Figure 4:
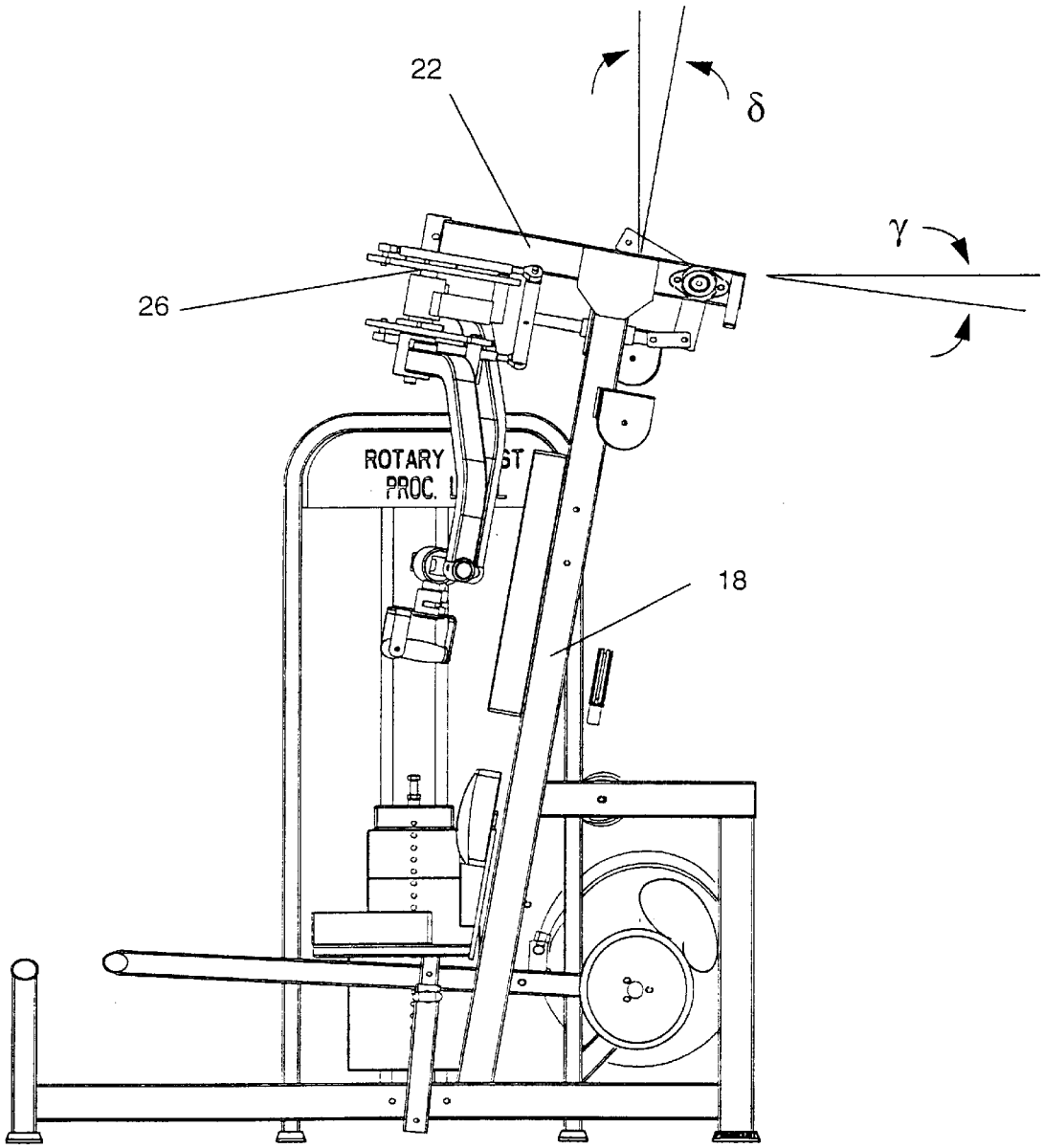
FIG. 4 is a side view of the chest press machine of FIG. 1.

Pivot support member 22 is fixedly connected to the support frame member 18 and placed in a plane forwardly inclined from a horizontal plane at an angle, preferably of 10 degrees, as shown in FIG. 4, so that the user need not support the weight of the exercise arms 24 and is placed at a comfortable seating position. The pivot support member 22 is at one end fixedly attached to the top of the support frame member 18 and at the other end supports two forwardly projecting exercise arms 24. Each exercise arm 24 has two sealed bearings 27 at one end, and rotates about an arm pivot axle 26, fixedly attached to the pivot support member 22. The arm pivot axle 26 is uniquely positioned so that the machine-determined circular exercise motion path is coincident with the movement of the wrist joint accommodating pivot 39, shown in FIG. 3, from start to finish of an exercise, to fit individuals of all sizes. The arm pivot axle 26 is located in a plane parallel to the plane positioned through the user's shoulder joints and at a lateral displacement $\gamma$ from it, at a predetermined location placed further into the exercise stroke than the plane positioned through the user's shoulder joints, as shown in FIG. 7 and identified as point A.

FIG. 3 shows the exercise arm 24, according to the present invention. It shows an adjustable handle assembly 32, which is adjustable to define the size of the exercise motion path, according to the user's arm length. Each adjustable handle assembly 32 is mounted to one exercise arm 24. The adjustable handle assembly 32 ends in a handgrip stirrup 34 with a durable contoured handgrip 36 and pivots at 39 on a sealed ball bearing 38. Each adjustable handle assembly 32 is equipped with a handle adjustment pin 40 and an adjustment bar 42, preferably made of solid steel, attached at the end of each exercise arm 24 by bolting, pinning or the like, so that there is no pivot. There is also an adjustment sleeve assembly 44 placed over the adjustment bar 42 and connected to the handgrip stirrup 34 to provide position adjustment of the handle assembly 32. Each adjustment sleeve assembly 44 contains two sleeves 43 preferably made of high torque capacity Teflon impregnated material. A cable routing arc 31 is welded to the end of the exercise arm 24. The handle adjustment pins 40 are preferably made of steel and the adjustment bars 42 are preferably 1.5 inch square, and covered with a Teflon coating, to insure smooth handgrip stirrup 34 position adjustment and corrosion resistance. The handgrips 36 may be covered with rubber or similar material to provide a comfortable grip surface.

Each adjustment bar 42 has preferably nine openings 41 in order to allow for attachment of the adjustment sleeve assembly 44 to the adjustment bar 42 by the handle adjustment pin 40. This adjustment of the adjustment sleeve assembly 44 on the adjustment bar 42 provides for each handgrip stirrup 34 position adjustment of preferably 6 inches, which makes a 12 inch adjustment in the diameter of the exercise motion path. In addition, the adjustable handle assembly 32 of the present invention can have two different handgrip stirrup 34 models, one that is offset forward from the handle pivot and another that is not offset.

Figure 7:
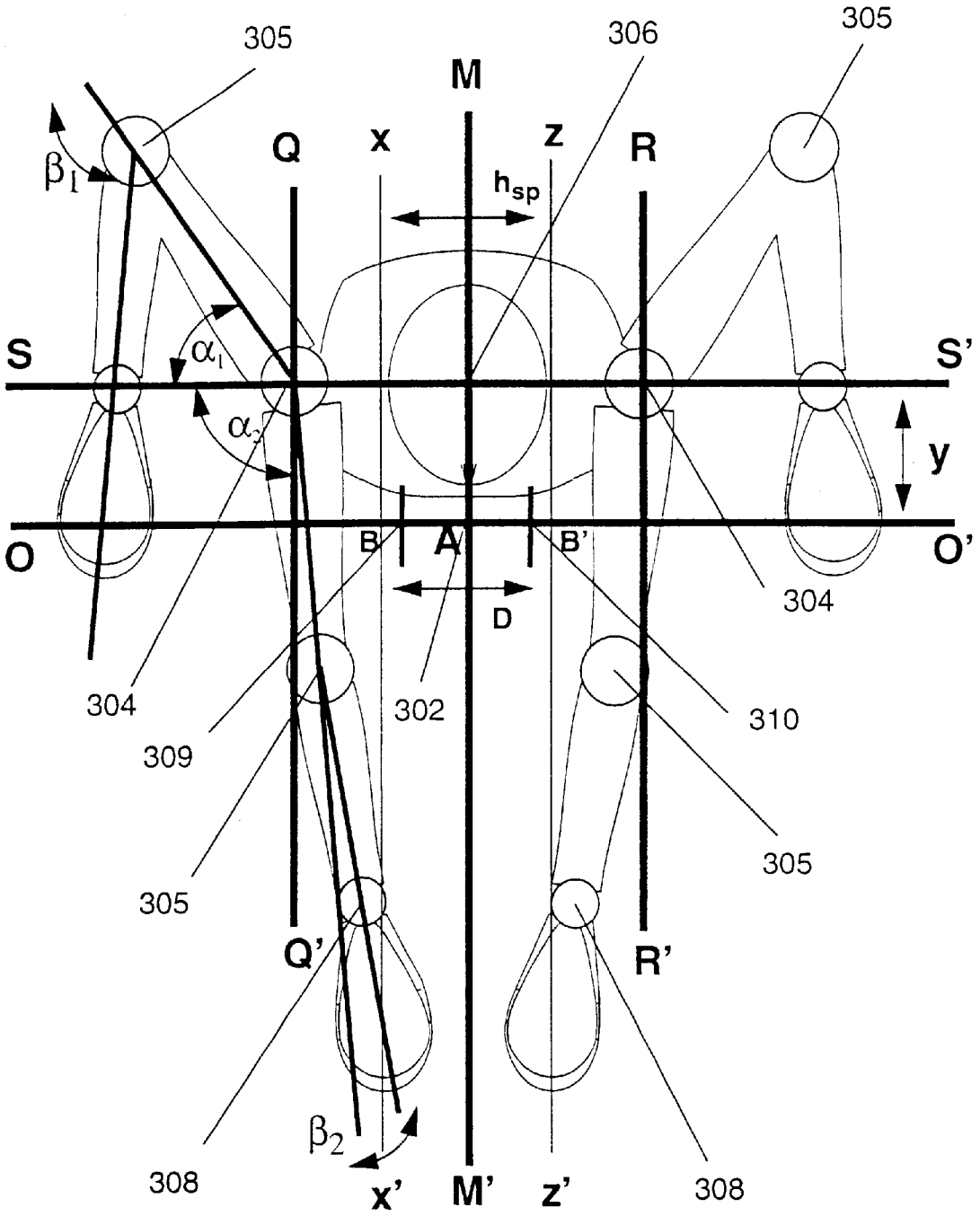
FIG. 7 is an illustration of the parameters of user's arms movements, from the starting to the ending point of the exercise motion path, applicable to all machines of the present invention.

For pressing movements on the chest press and shoulder press machines, the handgrip stirrup 34 pivots around a wrist joint accommodating pivot 39 with a sealed ball bearing 38, and is located in line with a user's wrist joint 308, shown in FIG. 7. The handgrip stirrup 34 is placed in front of the wrist joint accommodating pivot 39. In the course of exercise, the user can rotate each handgrip stirrup 34 separately relative to the other, so that user's hands may move in a non-circular motion path, whereby the user's hands may describe asymmetric arcs since they can rotate about the corresponding wrist joint accommodating pivot 39 In other two machine models, for upper back and lat pulls, the handgrip stirrup 34 pivots around the wrist joint accommodating pivot 39 which is placed in line with the center of the user's hand.

The exercise arms 24 are coupled to a conventional resistance mechanism, represented in the preferred embodiment of the present invention with a conventional stack of weight plates 50, although the invention may also be practiced with other means for supplying resistance. The number of weight plates 50, and thereby the resistance, can be manually selected. Weight plates 50, are preferably precision machined and move vertically on two guide rods 51, provided within a support frame 52. The top weight of the weight plates 50 is coupled to a weight stack cable 70, shown in FIG. 2. A selector shaft, not shown, extends down from the top of the stack of weight plates 50 through each weight plate 50.

A selector pin, not shown, is inserted into the selector shaft between the weight plates 50 to select the desired amount of weight to be used for the exercise. The construction of the user-selectable selectorized stack of weight plates 50 is well known in the art. The weight plates 50 are preferably precision machined alloy weight plates with floating polyethylene bushings, to insure smooth and quiet travel on the guide rods 51. Selector shaft is preferably made of cold rolled steel and having 1 inch diameter. The selector pin is equipped with a positive lock.

Figure 2:
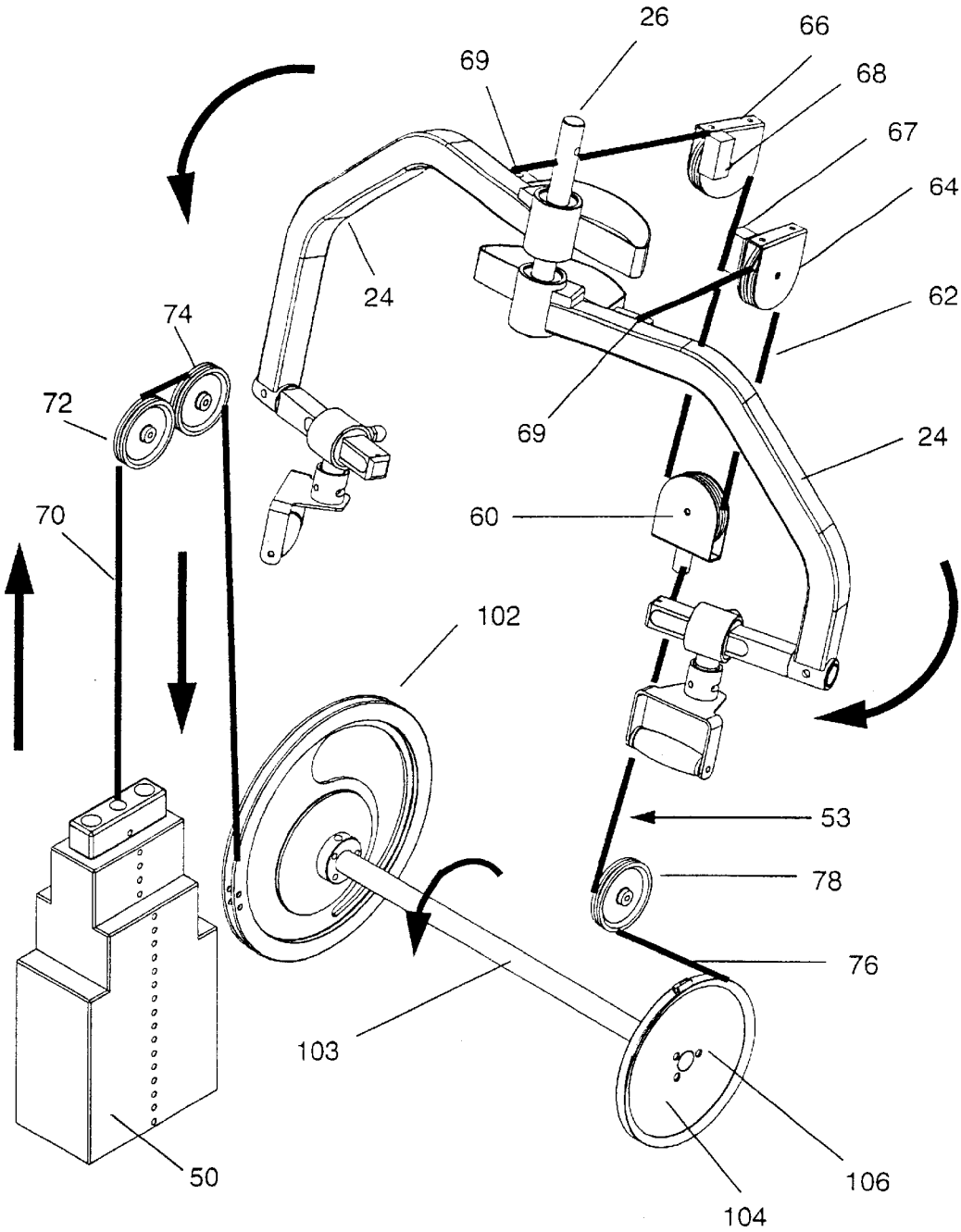
FIG. 2 is a perspective view of a cable and pulley system, cam system and weight plates of the first embodiment of the present invention presented in FIG. 1.

The weight plates 50 are coupled to the exercise arms 24 through a cable and pulley system 53. FIG. 2 shows the cable and pulley system 53, compatible with the embodiment of the invention shown in FIG. 1. The cable and pulley systems 53 for other machine models of the present invention are similar. As shown in FIG. 2, the weight stack cable 70 is attached to the top weight plate 50 and is trained upward and around two weight stack pulleys 72 and 74, and is then trained downward alongside support frame 52 and secured to a cam 102. A load multiplying pulley cable 76 is tied at one end to a load multiplying cam 104 and is then trained around a drive pulley 78 and attached at the bottom of a floating pulley 60. When the exercise arm 24 is rotated about the arm pivot axle 26 away from the user, at least one weight plate 50 will be lifted, and when the exercise arm 24 is rotated in the direction toward the user, at least one weight plate 50 will be lowered back to the rest position.

A floating pulley cable 62 is trained upward around fixed pulleys 64 and 66, both of which are rotatably mounted to brackets 67 and 68. The floating pulley cable 62 is secured to arm attachment points 69 on corresponding exercise arm 24, with a bolt or other suitable attachment means. This provides equal resisting force to movements of the exercise arms 24. When the exercise arms 24 pivot forward, together or only one at the time, the floating pulley cable 62 is pulled forward, thus raising the floating pulley 60, which raises the load multiplying pulley cable 76, causing the turning of the load multiplying cam 104.

Turning of the load multiplying cam 104 causes turning of the cam 102, because these two cams are both fixedly mounted on a cam axle 103. Turning the cam 102 shortens the length of the weight stack cable 70 and the weight plates 50 are raised. The effective resistance for exercise on chest press machine model increases through the forward movement of the exercise arms 24 and rotation of the cam 102, providing a varying weight resistance to displace the exercise arms 24, to train all muscle groups in the user's torso through the natural strength curve.

All cables are preferably coated with nylon and fittings are preferably stainless steel and having breaking strength of 4200 lbs. Guide rods 51 are preferably made of chrome plated cold rolled steel, and preferably have 1 inch diameter. Pulleys'wheels are preferably made of reinforced fiberglass, and preferably have deep, V-shaped grooves. All axles and bearings used in the machines are preferably 1⅜ inches in diameter and are durable sealed ball bearings, although the ball bearings may be substituted by bronze or nylon bushings or other suitable pivotal couplings.

FIG. 1 also shows a foot support 80, which allows the user to anchor himself in a position against a seat back 88, and is preferably elevated and coated to prevent foot slipping. A seat assembly 84 is preferably placed in a horizontal plane. The seat assembly 84 is placed on a seat support post 86 and consists of a seat bottom pad 87 and an adjustable lumbar support 90. The support frame member 18 is holding the seat back 88 in a semi-reclined position. The adjustable seat assembly 84 has a seat height changer 82, providing adjustment for the user relative to the adjustable handle assembly 32. The seat support post 86 preferably has a gas assisted spring cylinder within it, for adjusting the height of the seat assembly 84.

The seat support post 86 is fitted with polyethylene seat sleeves, not shown, for smooth and quiet height adjustment of the seat assembly 84. The seat support post 86 is equipped with the seat height changer 82 for seat height adjustment between 19 and 24 inches, in order to place the center of the user's chest in the same plane with the adjustable handle assemblies 32, so that the adjustable handle assemblies 32 are aligned with the center point of the user's chest. The seat assembly 84 is fixed horizontally.

The chest press machine is equipped with an assist system 91 to preposition the exercise arms 24 for commencement of an exercise. The assist system 91 is preferably shaped as a lower lever 92 with a cross bar 93. As the user presses down on the cross bar 93 of the lower lever 92, connected to an assist mechanism cable, not shown, the lower lever 92 moves an upper lever 95 and a linkage 94, pivotally attached to a the pivot support member 22. As the linkage 94 moves, it pulls a plunger 30. The plunger 30 is connected to a pair of swing arms 28 rotatably mounted one on top of the other, on the arm pivot axle 26 as the exercise arms 24 and above them. Each swing arm 28 has a downwardly extending contact rod 29 mounted to one end of the swing arm 28. Each contact rod 29 is adapted to act on the corresponding exercise arm 24 by pushing the exercise arm 24 to the user entrance position. As the plunger 30 contracts in length, the swing arms 28 move forward and rotate about the arm pivot axle 26 and the contact rod 29 pushes the exercise arms 24 forward, allowing the user to get into position to start the exercise.

The system is also equipped with a cam system 100, which is a variable resistance unit and a load multiplier. The cam system 100 varies the resistance of the machine so that the user sees a force that is coincident with the force curve for the muscle being exercised. The cam system 100 has the cam 102 on each machine, to vary the resistance accurately and specifically for each exercise movement, and can duplicate the force profile for the exercised muscles. Therefore, the cam system 100 of the invention is specific for each machine type. Each cam 102, 104 has a circular casting design and preferably three cam openings 106 for mounting of the cams 102, 104 on an axle.

The openings 106 are preferably off-center on the cam 102. The cam axle 103 is then offset from the center of the cam 102, because the cam 102 profile at the beginning and ending portions of the movement needs to be gradual and less pronounced than in the middle of the movement, thus resulting in force profile that is felt by the user as uniform and smooth throughout the entire range of motion. Variable resistance feature is desirable but not mandatory in the machines of the present invention. If there is no need for the variable resistance, the floating pulley cable 62 can be directly coupled to the weight plates 50, as there is no need for the cam system 100, or the cam axle 103 can be mounted into the center of the cam 102.

FIG. 4 is a side view of the chest press machine of FIG. 1, showing the angles of inclination $\gamma$ and $\delta$. For the machines shown in FIGS. 4 and 8, the angle $\gamma$ is defined between the pivot support member 22 and a horizontal axis, and the angle $\delta$ is defined between the support frame member 18 and a vertical axis. For the machines shown in FIGS. 9 and 10, the angle $\gamma$ is defined between the arm pivot axle 26 and a vertical axis and the angle $\delta$ is defined between the support frame member 18 and a vertical axis.

Figure 5:
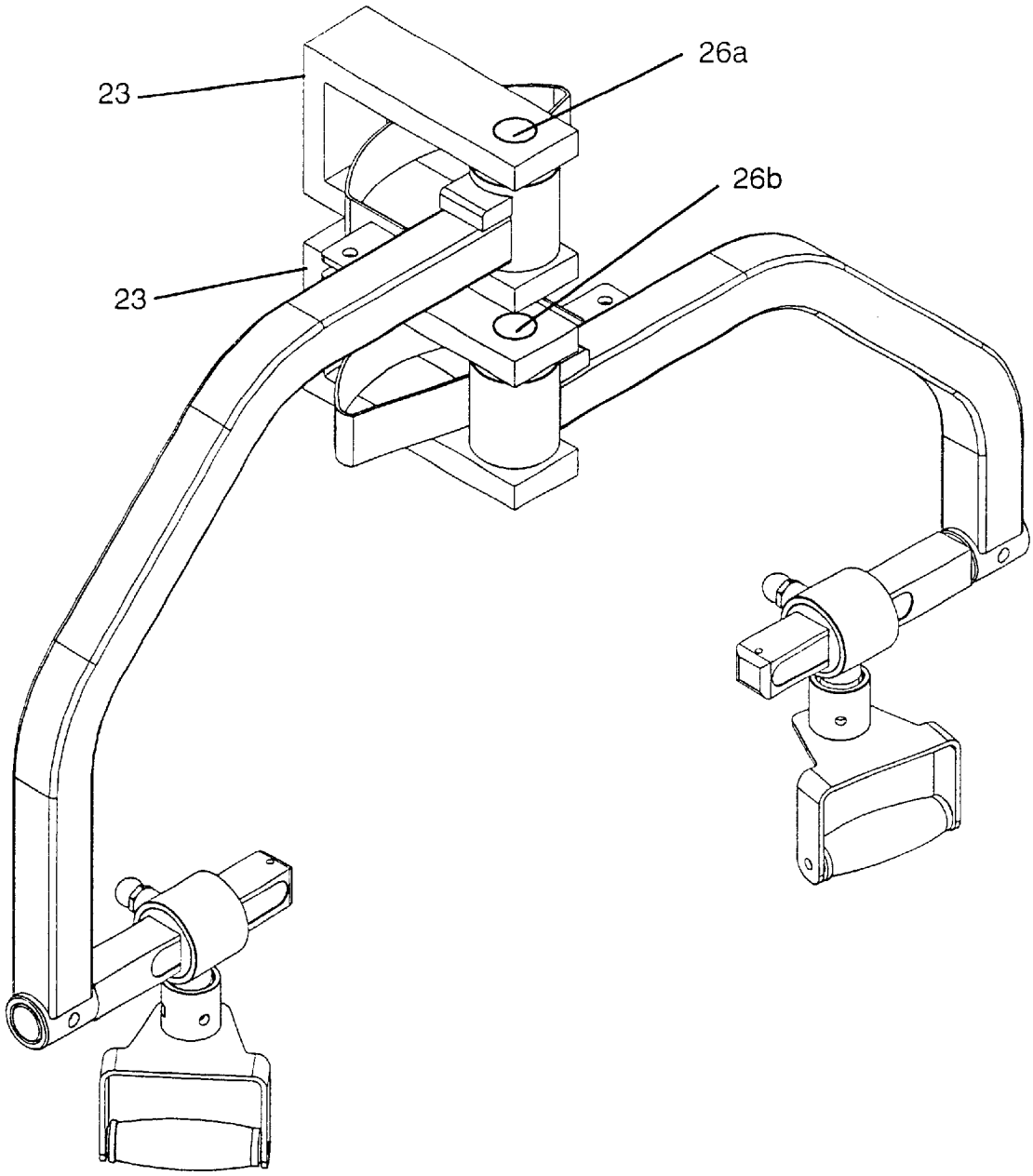
FIG. 5 is a perspective view of the position of two exercise arms for the embodiment of the present invention with co-linear arm pivot axles.

FIG. 5 is a perspective view of the position of two exercise arms for the embodiment of the present invention with co-linear arm pivot axles. It shows two arm pivot axles 26*a*, 26*b* placed one above the other in the same line. In this embodiment of the present invention, applicable to all four machine models, each arm pivot axle 26*a*, 26*b* is rotatably attached to an arm pivot axle attachment plate 23, fixedly attached to the pivot support member 22, in machine models shown in FIGS. 4 and 8, or to the support frame member 18 in other machine models. Since the arm pivot axles 26*a*, 26*b* are placed one beneath the other, the exercise arms 24 are not the same length, i.e., the longer one is attached to the higher-attached arm pivot axle 26*a* or 26*b* in order to keep the handle assembly 32 on the same level. In the preferred embodiment of the present invention, the arm pivot axle attachment plates 23 are U-shaped and are attached to the pivot support member 22 or the support frame member 18 by welding.

Figure 6:
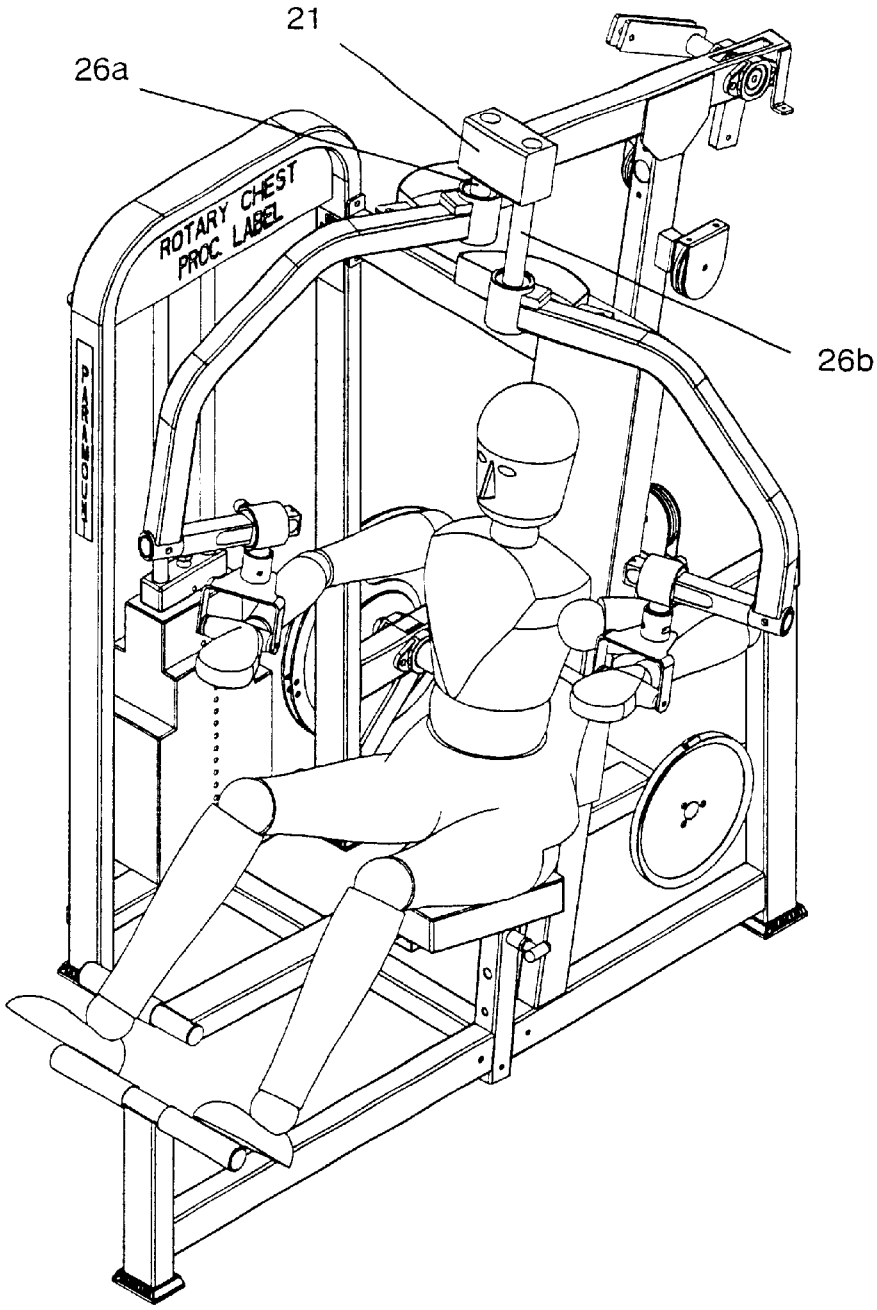
FIG. 6 is a perspective view of the chest press machine of FIG. 1, with parallel co-planar arm pivot axles.

FIG. 6 is a perspective view of the chest press machine of FIG. 1, with parallel co-planar arm pivot axles. In this embodiment of the present invention, applicable to all four machine models, two arm pivot axles 26*a*, 26*b* are placed parallel with each other in the same plane and rotatably attached to an arm pivot axle connector 21, fixedly attached to the pivot support member 22, in machine models shown in FIGS. 4 and 8, or the support frame member 18 in other machine models. In order to allow passage of the cable routing arcs 31, the arm pivot axles 26*a*, 26*b* are not the same length. Therefore, the exercise arms 24 are not the same length, i.e., the longer one is attached to the shorter of the arm pivot axles 26*a* and 26*b* in order to keep the handle assembly 32 on the same level.

The exercise is performed by pressing forward against the selected resistance until the user's arms are outstretched.

Prior to getting in the machine, the user adjusts the adjustment sleeve assemblies 44 along the adjustment bar 42, which determines the diameter of the movement arc appropriate to the size of the user. A taller person will push the adjustment sleeve assembly 44 further out from the center of the machine and the shorter person will place the adjustment sleeve assembly 44 closer to their body and the center of the machine.

The handle assembly 32 pivots about the wrist joint accommodating pivot 39, allowing the user's hand to pivot about the wrist joint, defining an arc that is determined by the length of the user's arms. User's exercise movement on the machines of the present invention is more refined, smooth and fluid because it is machine-determined and adjusted for the individual user.

Exercise arms 24 swing forward in a predefined arc, about the arm pivot axle 26, which is preferably welded or pinned to the pivot support member 22. The handle assemblies 32 pivot on the wrist joint accommodating pivots 39 and come together at the end of the exercise movement. In the chest machine of the present invention shown in FIG. 1, the singular central pivot point for the exercise arms 24 is the arm pivot axle 26 of the machine and it has the lateral displacement y of 4 to 6¼ inches, and preferably 5⅝ inches, from the plane positioned through the user's shoulders.

The machines of the present invention are designed to perform natural articulation of user's shoulder, elbow and wrist joints. Therefore, all embodiments of the chest press machine of the present invention, with a singular arm pivot axle, two co-linear arm pivot axles and two co-planar arm pivot axles, have been analyzed and data have been collected in order to determine the best position of the arm pivot axle(s) 26, 26*a*, 26*b*. Further, after the data have been obtained by empirical methods, an envelope encompassing all collected data has been defined by five functions in order to obtain the best fit encompassing all the collected data. The constants of the equations may vary slightly from machine to machine. Therefore, the results presented herein should not be considered as limitations but only as representations.

FIG. 7 is an illustration of the parameters of user's arms movements, from the starting to the ending point of the exercise motion path, applicable to all machines of the present invention. FIG. 7 is an overhead view of a user, showing the desired beginning and ending articulation points and angles. The user's joints are identified by a shoulder joint 304, elbow joint 305, and the wrist joint 308. A plane passing through the center of both shoulder joints 304 is defined as plane S–S'. For comfortable movement, the wrist joint 308 cannot pass to the backside of the plane S–S'. A plane normal to the S–S' plane passing through the centerline of the body is defined as M–M' plane. Two additional parallel planes X–X' and Z–Z', spaced apart by an offset $h_{sp}$, are used in FIG. 7 to show spacing between the adjustable handle assemblies 32. The planes X–X' and Z–Z' define the furthest forward position of the user's wrist joints 308 before the adjustable handle assemblies 32 collide. The distance of the planes X–X' and Z–Z' from the M–M' plane is 6 inches (3 inches to each side of the plane M–M'). The offset plane O–O' for the arm pivot axle(s) 26, 26*a*, 26*b* is offset from the plane S–S' by the displacement y. The planes Q–Q' and R–R' pass through each user's shoulder joint 304, respectively, and are normal to the plane S–S'.

For complete natural articulation, the user's wrist joint 308 cannot pass to the outside of the planes Q–Q' and R–R' at the end of the movement. The location of the singular arm pivot axle 26 is designated as point A 302, and it applies to the machines with a singular arm pivot axle 26. The locations of two arm pivot axles 26*a*, 26*b* are designated as B 309 and B' 310, and are spaced apart by an offset D (each pivot B, B' is offset by D/2 to each side of the plane M–M'). The offset D will vary from zero, for a singular axle machine, to a maximum value determined by the displacement y.

In FIG. 7, the amount of user's shoulder flexion at the beginning of the movement is defined by angle $\alpha_1$. The amount of user's shoulder extension at the end of the movement is defined by angle $\alpha_2$. The total amount of user's shoulder articulation is, therefore, $\alpha_1+\alpha_2$. User's elbow flexion is defined by angles $\beta_1$ and $\beta_2$.

For natural articulation, the beginning flexion angle $\alpha_1$ for the shoulder joint 304 is between 45 and 55 degrees. The ending extension angle $\alpha_2$ of the user's shoulder joint is between 80 and 90 degrees, and the optimum ending extension angle $\alpha_2$ is 85 degrees. The beginning elbow flexion angle $\beta_1$ is between 100 and 130 degrees, and optimally 130 degrees. At the ending point of the motion, the ending elbow flexion angle $\beta_2$ is between 5 and 25 degrees and optimally 15 degrees.

For the values of the displacement y and offset D as specified above, the wrist joint 308 could not pass behind plane S–S' when the angles $\beta_1$ and $\alpha_1$ are limited to their initial position range. Likewise, the wrist joint 308 could not pass planes X–X' and Z–Z' or fall to the outside of planes Q–Q' and R–R' when the angles $\beta_2$ and $\alpha_2$ are set within their ranges for the ending articulation.

The optimum position for a singular arm pivot axle A 302, when D=0, is at the displacement y=5.625 inches. The usable range of values for the displacement y and offset D is an envelope region bordered by straight line functions placed at the offsets D equal to D=0 and D=9.8 inches, and the following three functions for y relative to the offset D:

$$t_D = 6.4 - 1.58^{\frac{-7.0}{0.5D^2+1.5D+1.5}} - 0.09D$$

$$f_D = 4.68 - 1.85^{\frac{-1.15}{0.5D^2+0.25D+1.75}}$$

and $$g_D=3.7+0.0008D^{2.5}-0.0006D^2-0.0095D$$

The functions $t_D$, $f_D$ and $g_D$ define the lateral displacement y in relation to the offset D and provide a good fit to the collected data. The function $t_D$ is the top border of the envelope region. The function $f_D$ represents one part of the bottom border of the envelope region, from D=0 to D=6. The function $g_D$ represents the other part of the bottom border of the envelope region, from D=6 to D=9.8.

All four machines models, for chest press, shoulder press, lat pull and upper back, can be operated unilaterally, one exercise arm 24 pivoting at the time, so the movement of one exercise arm 24 is independent and does not cause a corresponding movement of the other exercise arm 24. Thus, the user can exercise the left and the right side of the body independently, in which case the handgrip 36 of the exercise arm 24 can be moved beyond the longitudinal center line of a machine, while the other exercise arm 24 is held in the starting position. This feature is important in an injury situation for rehabilitation purposes, or when one side of the body needs more exercise than the other.

Unilateral operation mode is made possible with a unique design of the floating pulley 60 and the other elements of the cable and pulley system 53, shown in FIG. 2, which provides separate resistance for each exercise arm 24. When only one exercise arm 24 is used, the floating pulley 60 is not allowed to go all the way up to the fixed pulleys 64 and 66, but only the half distance between the floating pulley 60 and the fixed pulleys 64 and 66, allowing the user to lift the total weight by using one arm with half the total force of both arms. If the unilateral movement is not needed, the floating pulley 60 can be replaced with a flat bar, clips, links or other means, not shown, to which the floating pulley cable 62 is coupled, and by directly linking the floating pulley cable 62 to the drive pulley 78.

Figure 11:
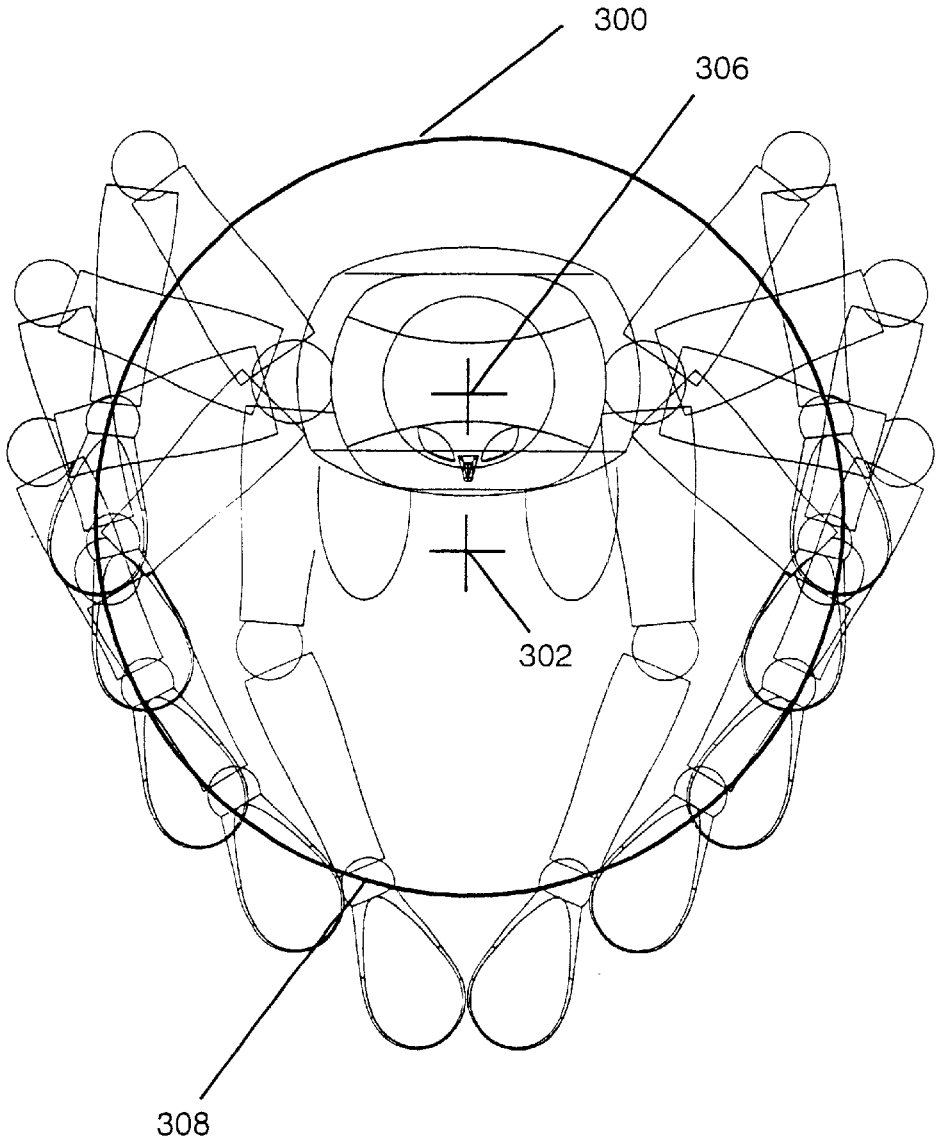
FIG. 11 is an illustration of the user's arms movements, from the starting to the ending point of the exercise motion path, obtained on all machines of the present invention.

In all the machines of the present invention, the arc of the machine-determined circular exercise motion path is coincident with the movement of the wrist joint accommodating pivot 39 from start to finish of an exercise. FIG. 11 shows a circular arc 300 that illustrates the exercise arm 24 movement on the machines of the present invention, which coincides with the movement of the wrist joint accommodating pivot 39 from start to finish of an exercise. The center 302 of the circle corresponding to the exercise path arc 300, which defines the position of the arm pivot axle 26, is located in a plane parallel to the plane positioned through the user's shoulder joints and at a lateral displacement y from it, marked in FIG. 12 as the displacement y, and at a location further into the exercise stroke than the parallel plane, defined above.

In the machines of the present invention used with pressing movement, the handgrip stirrup 34 is offset forward of the wrist joint accommodating pivot 39, and the wrist joint accommodating pivot 39 is located in line with the user's wrist joint 308, for rotation of the user's wrist joint 308 about the wrist joint accommodating pivot 39. Therefore, each users hand is allowed to move freely and separately relative to the other user's hand, and allowing user's hand to move in a non-circular motion path, whereby the user's hands may describe asymmetric arcs, since they can rotate about the corresponding wrist joint accommodating pivot 39.

Figure 12:
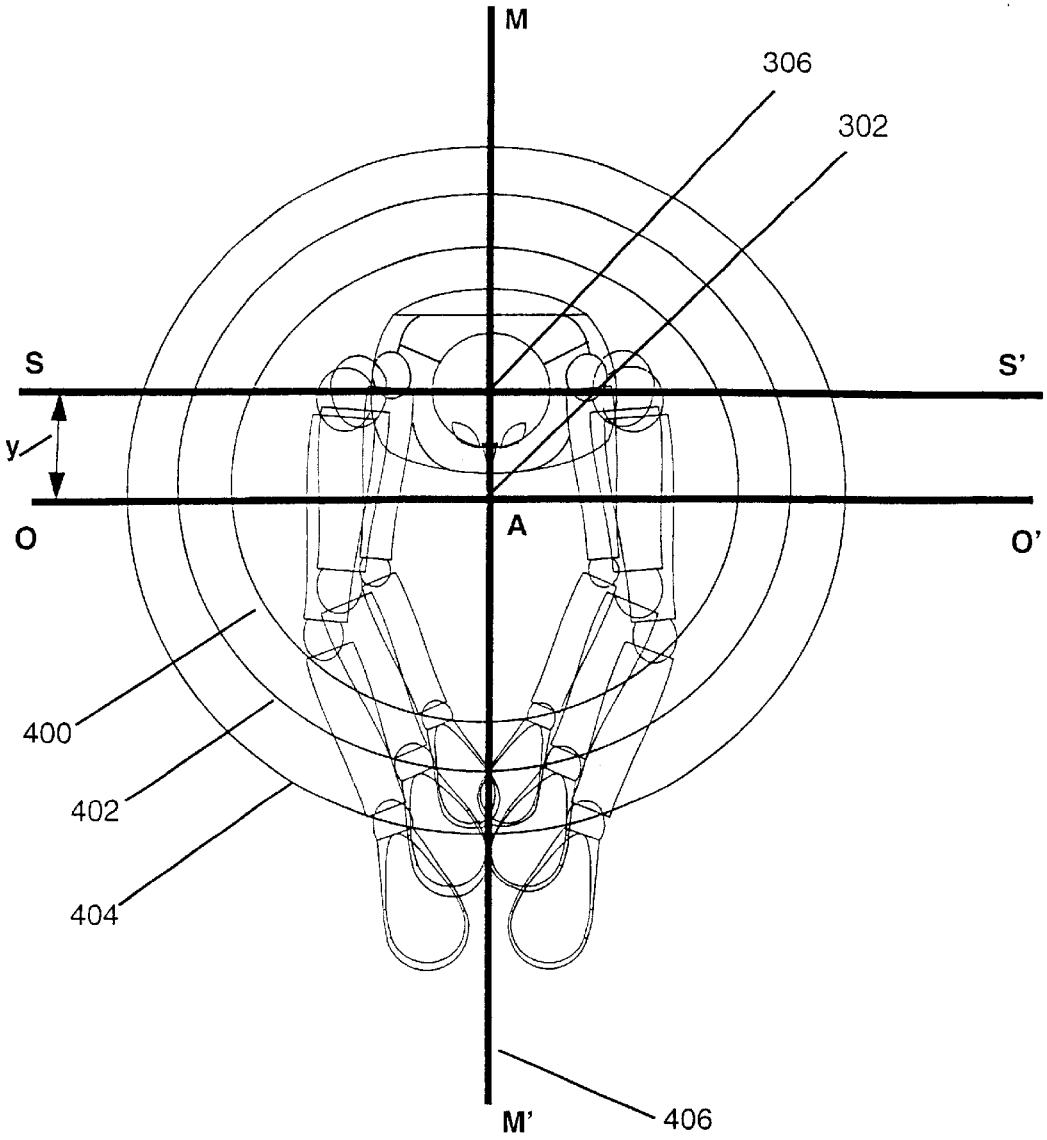
FIG. 12 shows a compilation of the arm movements of a full spectrum of male and female users, represented with an arc defined by the arm movement of the 5th percentile female, an arc defined by the arm movement of the 50th percent male and an arc defined by the arm movement of the 95th percentile male, obtained on the machines of the present invention.

FIG. 12 shows a compilation of the arm movements of a full spectrum of male and female users, using the machines of the present invention, represented with an arc 400 made by the 5th percentile female, an arc 402 made by the 50th percent male and an arc 404 made by the 95th percentile male, all having the same center point 302 which is the point for the arm pivot axle 26 of the machine. FIG. 12 shows that, on the machines of the present invention, all users finish at the same ending position plane 406, so that all users can attain much closer ending point and much more comfortable beginning point.

When extended, these arcs 400, 402 and 404 create three concentric circles, and the diameters of the circles range from 26 to 38 inches. The displacement y ranges between 4 and 6¼ inches and preferably 5⅝ inches, as mentioned above, and corresponds to the center of the exercise path arc 302. The arcs 400, 402 and 404 coincide with the movement of the wrist joint accommodating pivot 39 from start to finish of an exercise.

The chest press machine model is created for chest push movement. The upper back machine model is designed for upper back pull movement. The shoulder press machine model is created for shoulder muscles push movement. The lat pulldown machine model is designed for lat pull movement. All the machine models of the present invention can be used by people of any experience level and body size, and they provide complete ergonomic compatibility with all users. Preferably, the height of all the machines of this invention varies between 60 and 77 inches, the width, including the exercise arms 24 swing, varies between 56 and 59 inches, and the length of the machines varies between 53 and 74 inches.

Chest press machine model, shown in FIGS. 1, 4–6, has the seat bottom pad 87 parallel to a horizontal plane. This model also has the lumbar support 90 which is adjustable with the seat assembly 84, elevated foot support 80, the assist system for entry/exit 91, the cam system 100 and the cable and pulley system 53 placed in the back of the machine. In this machine the user is facing away from the support frame member 18. The arm pivot axle 26 has a predetermined offset angle from a vertical axis which is less than 45 degrees and preferably 10 degrees. The wrist joint accommodating pivot 39 is located in line with the user's wrist joint 308. The support frame member 18 is positioned in a plane backwardly declined from a vertical plane at an angle less than 45 degrees and preferably 10 degrees. The pivot support member 22, connected between the support frame member 18 and the arm pivot axle 26, is positioned in a plane forwardly inclined from a horizontal plane at an angle which is less than 45 degrees and preferably 10 degrees.

Figure 8:
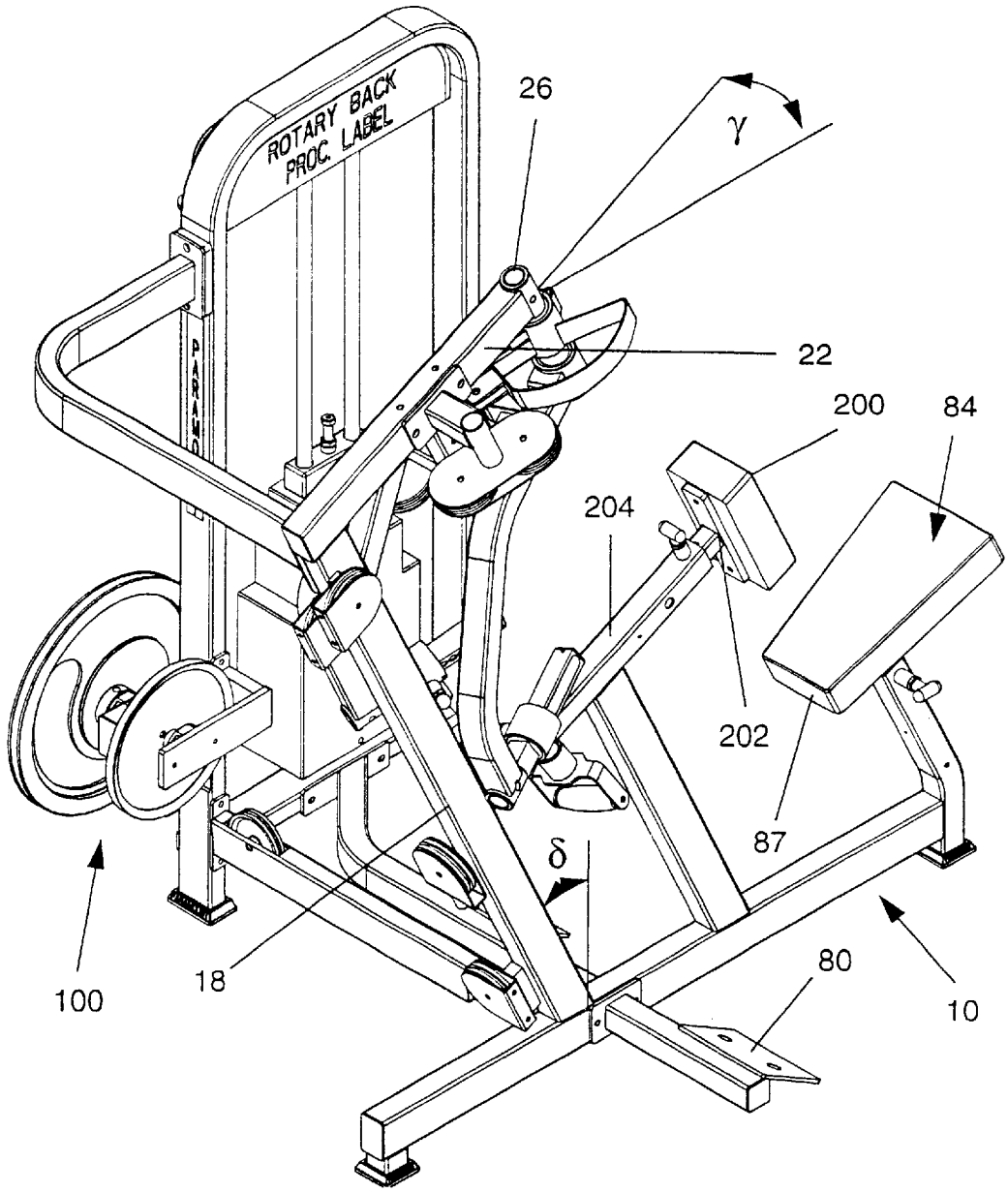
FIG. 8 is a perspective view of an upper back machine, according to another embodiment of the present invention.

FIG. 8 is a perspective view of the upper back machine, showing basic architecture of another embodiment of the present invention. This machine model is an upper back/row pullaway machine which has an adjustable chest pad 200, which can be moved horizontally, to allow the user to adjust the placement of the central pivot of the machine in regard to the user's body. The chest pad 200 is placed on a chest pad support post 202, which telescopes within a tubular member 204, in order to adjust the chest pad 200 placement along the length of the chest pad support post 202, in front of the user's chest, for support during exercise. Adjusting the position of the chest pad 200 changes the user's body center with respect with the machine center, to help the isolation and concentration of the muscles being exercised.

On this machine, the starting and ending positions are generally inverted from the chest press machine model and the exercise arms 24 are pulled rearwardly against the resistance. The upper back machine model has a different frame 10 design, the seat assembly 84 is forwardly declined, and the arm pivot axle 26 is placed in a plane in front of the user rather than above the user's head. The machine has the adjustable chest pad 200 and seat cushion 87, elevated foot support 80, and cam system 100 and cable and pulley system 53 placed in front of the machine. The user faces toward the support frame member 18. The arm pivot axle 26 and the seat bottom pad 87 are forwardly declined and having a predetermined offset angle from a vertical axis which is less than 45 degrees and preferably 25 degrees. The wrist joint accommodating pivot 39 is located in line with the user's hand.

The support frame member 18 is positioned in a plane forwardly declined from a vertical plane at an angle less than 45 degrees and preferably 25 degrees. The pivot support member 22, connected between the support frame member 18 and the arm pivot axle 26, is positioned in a plane forwardly declined from a horizontal plane at an angle which is less than 45 degrees and preferably 25 degrees.

Figure 9:
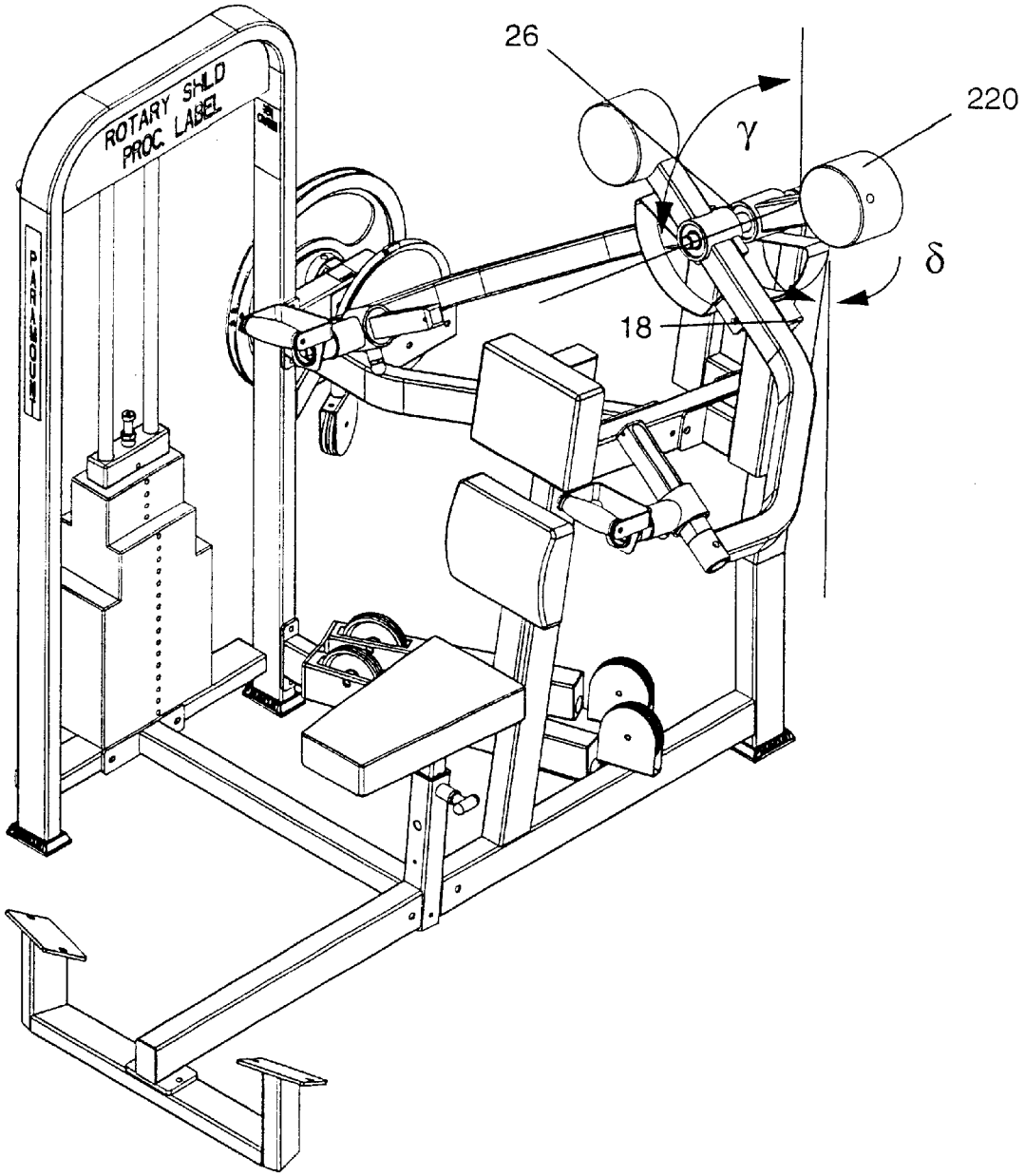
FIG. 9 is a perspective view of a shoulder press machine, according to another embodiment of the present invention.

FIG. 9 is a perspective view of a shoulder press machine, showing basic architecture of another embodiment of the present invention. This machine model has a near-horizontal arm pivot axle 26, placed in the back of the machine. The seat support post 86 has a 5 degree backwardly inclined angle, and the cam system 100 and cable and pulley system 53 are placed in the back. The machine also has the adjustable lumbar support 90, elevated foot support 80, and exercise arms 24 equipped with counter-weights 220, which reduce the initial weight of the exercise arms 24.

In this machine the user is facing away from the support frame member 18 positioned in a plane backwardly declined from a vertical plane at an angle less than 45 degrees and preferably 10 degrees. The arm pivot axle 26 is placed behind the seat assembly 84 and has a predetermined offset angle from a vertical axis which is more than 45 degrees and less than 90 degrees and preferably 80 degrees. The exercise arms 24 are rotating in an upright plane, and the wrist joint accommodating pivot 39 is located in line with the user's wrist joint 308.

FIG. 10.*a* is a perspective view of a lat pulldown machine, showing basic architecture of another embodiment of the present invention. This machine model has a near-horizontal arm pivot axle 26 of the exercise arms 24, and the seat cushion 87 is parallel with a horizontal plane. There are two seat cushion adjusters 222 and 224 for adjustment in two positions so that seat cushion 87 pivots 180 degrees. The user can turn toward the back of the machine and face the arm pivot axle 26, or, by pivoting the seat assembly 84 for 180. degrees, the user can face away from the arm pivot axle 26. Cam system 100 and cable and pulley system 53 are placed behind the user in front of the machine, and exercise arms 24 have counter-weights 220.

Padded leg rollers 230 are used as a restraint for legs in this machine model, in order to keep the user's legs under them, if lifting more weight then the user's own weight. The height of the leg roller 230 can be adjusted with a leg roller handle 236, shown in FIG. 10.*b*. The support frame member 18 is positioned in a plane backwardly declined from a vertical plane at an angle less than 45 degrees and preferably 10 degrees. The arm pivot axle 26 has a predetermined offset angle from a vertical axis which is more than 45 degrees and less than 90 degrees and preferably 80 degrees. The exercise arms 24 rotate in an upright plane, and the wrist joint accommodating pivot 39 is located in line with the user's hand.

Exercise machines of the present invention provide articulation of the muscles of the arms and upper torso through a natural ergonomic exercise motion path. User's shoulder, elbow and wrist joints are taken through their complete ranges of motion, during the course of the exercise movement, without a wrist impingement, thus decreasing the stress in these joints and keeping the proper muscle balance, which is not possible in conventional machines but only with free-weight dumbbells. User's exercise movement on the machines of the present invention is more refined, smooth and fluid, because it is machine-determined and adjusted for the individual user, giving the training associated, and previously only available, on free-weight dumbbells for advanced users.

The present invention provides machines to be used by men and women of varying body size and structure, to give them the same joint articulation and same training benefits, in a safe and reliable manner, and provide optimum exercise results for a wider range of users than presently available machines.

While this invention has been described with reference to its presently preferred embodiment(s), its scope is only limited insofar as defined by the following set of claims and all equivalents thereof.

What is claimed is:

1. A convergent exercise machine, comprising:

a support frame;

a support frame member coupled to the support frame;

an arm pivot axle coupled to the support frame member, said arm pivot axle positioned in a first plane;

a seat assembly comprising a seat bottom pad and a seat back adapted to hold a user in position for exercising, whereby said user's shoulder joints are positioned substantially in a second plane, said second plane being substantially parallel to the first plane at a displacement perpendicular to the first plane;

the first plane being located further into an exercise stroke than the second plane, said exercise stroke being a pushing stroke in a direction away from the support frame member;

a pair of exercise arms, each having a first end rotatably attached to the arm pivot axle;

said pair of arms adapted to move in a convergent motion;

a handle assembly pivotably coupled to a second end of each exercise arm by a handle assembly pivot and adapted to be grasped by the user, wherein the arm pivot axle is positioned to define a machine-determined circular exercise motion path coincident with a movement of the handle assembly pivot from start to finish of said exercise motion path;

said handle assembly being adjustable to define the size of the circular exercise motion path;

each of said exercise arms being independently pivotal relative to the other exercise arm to allow the user to exercise one arm at a time;

said exercise motion path being in a third plane which is at a fixed angle relative to said first and second planes;

wherein said handle assembly pivot comprises a wrist joint accommodating pivot, said wrist joint accommodating pivot being disposed perpendicular to said third plane, whereby the exercise motion path for said wrist joint accommodating pivot is continuously in said third plane; and whereby rotation of the user's wrist joint is substantially constrained by the wrist joint accommodating pivot to move in an abduction-adduction, side-to-side, motion.

2. The machine of claim 1, wherein the handle assembly further comprises:

a handgrip stirrup which is offset from the wrist joint accommodating pivot;

said handgrip stirrup comprising a handgrip;

said offset being adapted to substantially position a user's hand so that a handgrip of a handgrip stirrup may be gripped by a user's hand to position said wrist joint accommodating pivot substantially in line with a user's wrist joint, and whereby rotation of the user's wrist joint is substantially constrained by the wrist joint accommodating pivot to move in an abduction-adduction, side-to-side, motion.

3. The machine of claim 1, wherein the handle assembly pivot is a wrist joint accommodating pivot, the displacement of the first and second planes is between 4 and 6¼ inches, and the diameter of the circular exercise motion path ranges from 26 to 38 inches.

4. The machine of claim 3, wherein the displacement of the first and second planes is about 5⅝ inches.

5. The machine as claimed in claim 1, wherein the handle assembly comprises a wrist joint accommodating pivot, the machine is a chest press machine adapted to receive the user facing away from the support frame member, the arm pivot axle and the support frame member being positioned in a plane backwardly declined from a vertical plane at an angle which is less than 45 degrees, the handle assembly having a handgrip portion offset from the wrist joint accommodating pivot and adapted to position the user's wrist joint substantially in line with the wrist joint accommodating pivot, the support frame member further comprising a pivot support member connected between the support frame member and the arm pivot axle, wherein the pivot support member is positioned in a plane forwardly inclined from a horizontal plane at an angle which is less than 45 degrees.

6. The machine of claim 5, wherein the angle the arm pivot axle and the support frame member are positioned in the plane backwardly declined from a vertical plane is about 10 degrees.

7. The machine of claim 5, wherein the angle the pivot support member is positioned in the plane forwardly inclined from the horizontal plane is about 10 degrees.

* * * * *